US005630675A

United States Patent [19]

Boeger

[11] Patent Number: 5,630,675

[45] Date of Patent: May 20, 1997

[54] TRAFFIC CHANNELIZER BASE

[75] Inventor: Michael A. Boeger, St. Louis, Mo.

[73] Assignee: Flex-O-Lite, Inc., St. Louis, Mo.

[21] Appl. No.: 531,101

[22] Filed: Sep. 29, 1995

[51] Int. Cl.[6] ..... E01F 13/02

[52] U.S. Cl. ..... 404/6; 116/63 C; 404/10

[58] Field of Search ..... 404/6, 9, 10, 12, 404/13; 256/13.1; D10/109; 40/612; 116/63 P, 63 C; 220/603; 248/910

[56] References Cited

U.S. PATENT DOCUMENTS

| | | | |
|---|---|---|---|
| 2,448,413 | 8/1948 | Borghesi | 248/194 |
| 2,762,327 | 9/1956 | Weig | 116/63 |
| 2,843,347 | 7/1958 | King | 248/44 |
| 2,977,864 | 4/1961 | Puller | 94/22 |
| 3,119,588 | 1/1964 | Keats | 248/158 |
| 3,471,114 | 10/1969 | Ball | 248/346 |
| 3,738,309 | 6/1973 | Nicholl | 116/63 |
| 4,083,033 | 4/1978 | Kulp et al. | 340/114 |
| 4,145,044 | 3/1979 | Wilson et al. | 273/1.5 |
| 4,303,349 | 12/1981 | Upton | 404/6 |
| 4,312,600 | 1/1982 | Schaaf et al. | 404/6 |
| 4,475,101 | 10/1984 | Kulp et al. | 340/114 |
| 4,674,431 | 6/1987 | Cory | 116/63 |
| 4,688,766 | 8/1987 | Zucker | 256/131 |
| 4,710,053 | 12/1987 | Kulp et al. | 404/9 |
| 4,889,067 | 12/1989 | Provence, Jr. | 248/910 X |
| 5,026,204 | 6/1991 | Kulp et al. | 404/10 |
| 5,103,616 | 4/1992 | Nordberg | 52/585 |
| 5,201,599 | 4/1993 | Kulp et al. | 404/6 |
| 5,234,280 | 8/1993 | Cowan | 404/9 X |
| 5,451,118 | 9/1995 | Wilkens et al. | 404/6 |
| 5,529,429 | 6/1996 | Pelegrin | 404/9 |

*Primary Examiner*—George A. Suchfield
*Attorney, Agent, or Firm*—Edward H. Renner

[57] ABSTRACT

An improved two-piece, detachable traffic device features a high-density, low-profile solid base. The base is, preferably, made of a molded unitary composition made of recycled rubber products, such as, spent motor vehicle tires. Further, it is molded such that it can be stacked for ease of storage with similar bases. The combined high-density and low profile flexible aspects of the base cooperate to ensure both that the base remains stationary during use and can easily be traveled over by a vehicle without damage resulting to the base or the vehicle. The mass of the base is concentrated at the periphery of the base to maximize the self-righting effect of the base while minimizing the over all weight of the base and material required.

15 Claims, 1 Drawing Sheet

TRAFFIC CHANNELIZER BASE

FIELD OF THE INVENTION

This invention relates to an improved traffic channelizing device and, more particularly, to a two-piece, detachable device formed as a barrel and a base. The base portion is a high-density, unitary construction and is specially adapted to remain stationary and avoid entanglement with a motor vehicle following impact of the vehicle with the combined barrel and base.

We are aware of the following U.S. patents, the disclosures of which are incorporated by reference herein:
U.S. Pat. No. 4,083,033
U.S. Pat. No. 5,026,204
U.S. Pat. No. 5,201,599
U.S. Pat. No. 5,451,118

BACKGROUND OF THE INVENTION

Traffic channelizing devices are used to warn and alert motorists of hazardous conditions existing on or about roadways and to direct or channel them along a designated course which may differ from the ordinary traffic route, for example, to direct traffic around construction areas.

Channelizers exist in a great many configurations and are made from a number of materials. For example, early on, fifty gallon steel drums were used as channeling devices, as are the orange, rubber cones with which most are familiar. Steel drums have largely been replaced by plastic barrels; plastic barrels are now commonly used in -situations where traffic channelization is intended for a sustained period of time or where high visibility is required. These plastic barrels are of a size and appearance suggestive of the steel drums and appear sufficiently formidable to warn motorists of hazards.

In order to impart added stability to plastic barrels, they are often filled with ballast, typically sand. In use, and particularly when ballasted, plastic barrels have proven to be effective, stationary devices capable of withstanding movement caused by wind and environmental variables or the irregular turbulence created by large, fast moving motor vehicles.

Despite the advantages of ballasted plastic barrels, there are disadvantages which derive from the use of ballast, particularly sand, as stabilizing material for traffic channelizers. Because it is inexpensive, readily available and relatively soft, sand is often selected for ballast. However, when the sand is spilled onto the roadway, for example, as the result of impact, it can reduce road contact of vehicle tires and create a condition which greatly impairs the motorist's ability to maintain control over the vehicle; both braking and steering can be affected.

An example of a ballasted plastic barrel is disclosed in U.S. Pat. No. 4,083,033. U.S. Pat. No. 4,083,033 discloses a two-piece plastic drum that can be assembled or detached and which has a plastic upper drum element and a plastic base in the shape of an open tray for receipt of a ballast. The device provides for the placement of loose or bagged sand placed in the open tray of the base to stabilize the combined barrel and base.

Certain significant problems are inherent to the two-piece device (actually a three-piece device given the requirement of a separate ballast) when in use, as noted above. Specifically, in ballasting with sand, the sand is most commonly placed in bags or stored in a soft breakable container which will dispense the sand, for example when run over by a motor vehicle tire or ripped by the vehicle undercarriage. Accordingly, sand is often spread across the roadway when there is a collision with a ballasted plastic barrel. This is undesirable from a safety perspective in that sand on dry pavement is known to reduce the friction coefficient between pavement and the surface of a tire, thereby increasing braking distances and making steering difficult. From an additional practical standpoint, the displacement of sand out of the ballast tray of the base creates more work and expense in that, prior to subsequent use, the sand ballast must be replaced and the dispersed sand removed from the roadway.

An additional disadvantage relating to some prior devices is that the base is typically made from a flexible, thermoformed plastic. After several impacts, and particularly when the base is either run over by a vehicle tire or entangled with the vehicle undercarriage, the base is damaged to the point that it can't be reused. Accordingly, the base element fails to provide important safety and durability considerations. In addition, the sand ballast has a significant height, creating an obstacle for vehicle tires, if struck directly.

In U.S. Pat. No. 5,026,204 the configuration of the base element is modified to provide for a molded, hollow chamber, which is filled through an opening, and then sealed. The vertical, height of this base is four inches. The base requires the inconvenient step of adding sand to the base—a function which invites human error. Moreover, by its nature, the thermoformed material comprising the base is vulnerable to the extremes and adverse affects of environmental factors, which factors invariably, threaten the structural integrity of the base, leading ultimately, to rupture of the base and dispersal of sand onto the surrounding pavement.

U.S. Pat. No. 5,201,599 also discloses a ballasted base. Like U.S. Pat. 5,026,204, this disclosure involves a molded, hollow chamber with an opening and a cover for receipt of a ballast and for use in conjunction with a first, barrel-like element. As distinguished from the preceding invention, however, the invention of this patent requires the placement of a solid ballast means within the dome-shaped, molded chamber. The disadvantages associated with this device are similar to those described above with respect to convenience, the possibility that the ballast will not be securely added to the base in order to avoid leakage, and the short life expectancy of the base due to the material of which it is constructed and the stress imposed upon that material by extreme environmental factors as well as that caused by the repeated insertion and removal of ballasting means.

More recently, a base for traffic barrels has been produced from recycled rubber. This base is described in U.S. Pat. application Ser. No. 08/344,355, filed Nov. 23, 1994, now U.S. Pat. No. 5,451,118. The recycled rubber base does not require a separate ballast and has a low profile which reduces the barrier effect of the base itself.

The present invention also overcomes the disadvantages described for ballasted bases and produces a truly two-piece channelizing device. The base element does not require the addition of a separate ballasting material. Accordingly, the present invention avoids the described problems associated with sand ballasted bases, including fillable bases, by providing a durable, high-density, ultra low-profile and unitarily solid base element made from an inexpensive material, such as recycled rubber. The base of this invention is an improved base of the self-ballasting type described in U.S. Pat. No. 5,451,118.

Disposal of solid waste, including used motor vehicle tires, is a major environmental problem. Landfill approval and environmental standards grow increasingly strict; fewer acceptable means of disposal remain. The present invention contributes to solution of the tire disposal problem by providing an additional commercial use for recycled tires. The instant invention, presents an environmentally prudent and responsible alternative to the landfilling of used motor vehicle tires. The rapid acceptance of the high density bases, by the highway safety industry, indicates that this product has positively contributed to recycling efforts for used tires.

The properties of rubber include exceptional durability, high density and a natural elastic character. These properties enable recycled rubber material to produce a base element which unexpectedly eliminates many of the hereto required labor steps and associated adverse safety implications of post-manufacture ballasting, while providing a device of exceptionally low profile suitable for being repeatedly impacted by motor vehicles without threat to its structural integrity, and thus, its expected useful life. The exceptionally low effective profile mitigates against loss of control of a motor vehicle, as can occur due to tire contact with a thick conventional base and ballast.

Moreover, the structure of the improved base permits a maximum ballasting effect without using excessive weight in the base, greatly increasing the convenience of use and economy of the base itself. A typical base of this type weighs between about eighteen to twenty pounds. This improvement is achieved by strategically placing the substantial portion of the mass of the base at the horizontal extremity or periphery of the base. The mass is also placed as low as possible, consistent with the functioning of the base. The center of the base is free of material, or substantially so. As a result, a strong self-righting moment is achieved by the base without the need for excessive mass. The weight of the base is thus substantially reduced. This also results in a cost of material savings as well as savings in shipping cost. Further, there is an added convenience in that the bases are easier to carry and use on the job. The lighter weight may also reduce the risk of worker injury. As a result, there may be a reduction of lost worker time, fewer insurance claims and a reduction in related costs.

SUMMARY OF THE INVENTION

The present invention provides an improved base for a traffic channelizing device which, due to its structural departure from conventional devices, materially improves upon the convenience of using and performance of traffic channelizing elements of the type known in the art. In particular, the improved base element for a two-piece attachable and detachable device eliminates the requirement that the base element be separately ballasted following manufacture and prior to use. Because of its high-density, unitary construction from recycled materials, low profile and specially molded configuration, the base is easily handled, is stackable, and is an economical, convenient, environmentally responsible and practical base for traffic barrels.

The base element is preferably a high-density, solid rubber molded article that does not require the addition of ballast, of any form, following manufacture and prior to use. The base is typically used in conjunction with a hollow element having a barrel-like configuration used for traffic channelization signaling purposes and adapted for attachment with and detachment from the base element. The base has sufficient weight to ballast the combined base and channelizer, i.e., plastic barrel, from displacement for example, from wind gusts.

The base element is also advantageously configured with a low profile, not exceeding three inches when measured at its highest vertical point, typically about two and one half inches. Due to the structure of the base, as described herein, and the resilience of the material, the effective height of the base, on impact, may be less. This low profile allows a base element that has been separated from the top element of the channelizer to have the desired clearance to fit under a motor vehicle as it passes over the element without engaging the undercarriage of the motor vehicle or any parts that may protrude therefrom. Unlike conventional base elements, the base element of this invention is of a solid construction. Therefore, the base element does not rupture when impacted, as described, thereby leaking ballast and compromising the utility of the device.

Owing both to its high-density and low profile features, the instant base element is designed to remain substantially in place even when impacted by a motor vehicle. On impact, the hollow element of barrel-like configuration, to which the base is attached, typically separates on account of the contact force. This aspect of the invention constitutes an important safety advance over the prior art in that existing sand-ballasted base elements, whether sealed within the base or disposed atop a base element (loose or bagged), present an obstacle to the motor vehicle once it has impacted the channelizer, sometimes resulting in loss of control of the vehicle due to engagement of the vehicle tires or under-side with a sand-ballasted base unit. Moreover, and as described more fully above, the spreading of sand upon the roadway following impact and rupture may create a wholly separate and added safety hazard.

The solid, unitary base of the present invention is also novel in the art because, unlike conventional sand-ballasted elements that are either dome-shaped or tray-configured and made of thermoformed plastic, the solid low profile and high-density rubber base provided hereby is designed to remain substantially in place while, simultaneously, fully withstanding being repeatedly driven over by all forms of motor vehicles without sacrifice of structural integrity and without becoming entangled with vehicle underbodies. In addition, a problem common to sand-ballasted base elements and relating to the detachment of the base from the barrel element upon impact, due to the effect of dispersed sand, is also overcome. A yet further advantage of the base element provided hereby resides in its ability to adapt for use with conventional commercially available top channelizer elements—obviating the need to purchase completely new top elements.

The present invention broadly embraces both a base element and a combined hollow, barrel-like top element. The top element may be of conventional design attachable to the base by a snap fit engagement. The base is generally annular. The top of the base is formed to lie in a plane and be received in the interior of a traffic barrel. The bottom surface of the base contacts the ground when the base is normally positioned. The mass and weight of the base is concentrated at the periphery of the base due to its annular shape, thereby maximizing the ballasting and anti-tipping effect while using a minimum of material. Further, the anti-tipping effect is increased by concentrating the mass as low as possible in the base, for example, by forming the base as a platform having a substantial portion of the mass of the base and with a raised portion for the latching member having less mass. The raised portion may be formed with a cross-section which also lowers the center of mass, for example, a tapered or triangular cross-section.

It is thus an object of this invention to provide a self-ballasting base for traffic barrels in which the weight is concentrated at the outer periphery of the base.

It is also an object of this invention to provide a base for traffic barrels, the base having increased flexibility and reduced height.

It is an object of this invention to provide a base which is easy to use on the job.

It is an object of this invention to provide a base which is self-ballasting and anti-tipping and which also maximizes the use of material.

It is an object of this invention to provide a solid base for traffic barrels having reduced weight and less cost.

It is an object of this invention to provide a base for traffic barrels having a low effective height and which provides a very low obstacle to traffic passing over the base.

These and other features will be apparent from the following Description of the Drawings and Description of the Preferred Embodiments.

DESCRIPTION OF THE PREFERRED EMBODIMENTS

Figure 1:
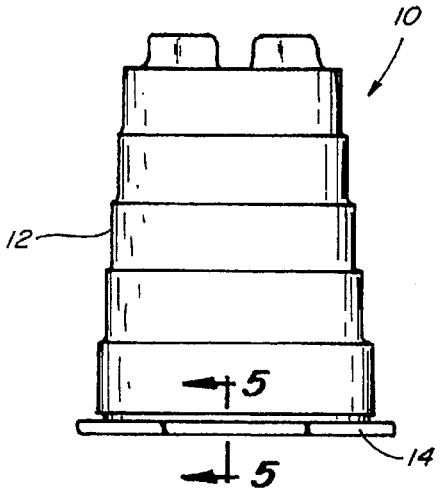
FIG. 1 is a plan view of a barrel and base according to the invention.
Figure 2:
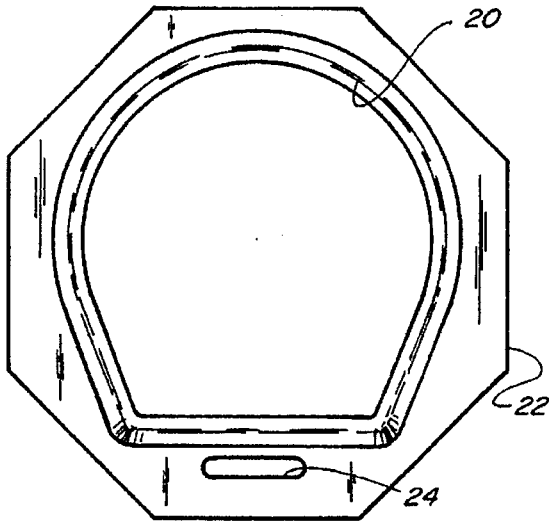
FIG. 2 is a top view of a base according to the invention.
Figure 3:
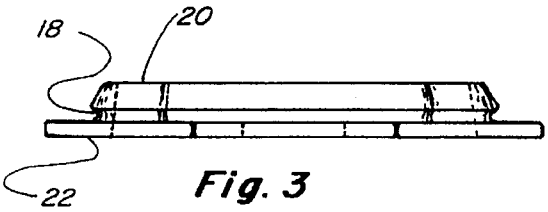
FIG. 3 is a plan view of the base of FIG. 2, showing the latching means.

Referring to FIG. 1, a combination barrel and base 10 according to the invention are shown. The combination 10 includes a plastic channelizer barrel 12, which may be of conventional design including round, or D shaped as shown. Barrel 12 fits on a complimentary base 14 and is releasable attached by a lip 16, shown in FIG. 5. Lip 16 engages with a projecting section 18 of the upper or pedestal portion 20 of base 14. As shown in FIGS. 2 and 3, projecting section 18 may be continuous, but it may also be a series of discontinuous lugs, not shown. It will be appreciated that continuous section 18 and discontinuous lugs are alternative engaging means for cooperating with lip 16 on barrel 12.

Figure 4:
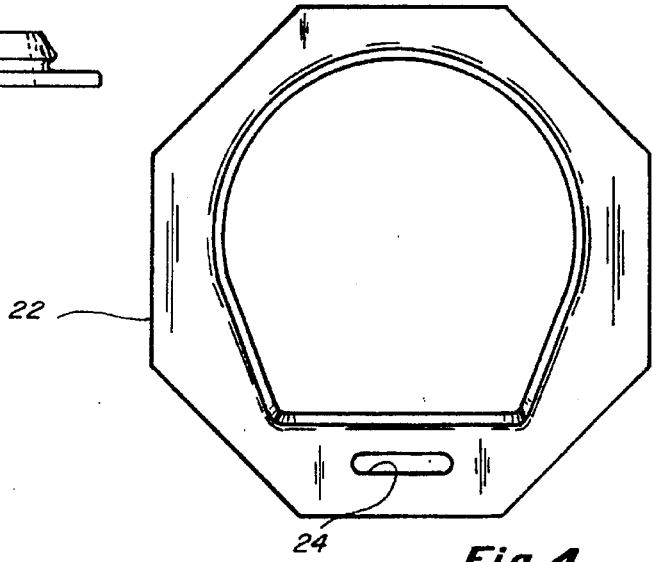
FIG. 4 is a bottom view of the base of FIG. 2.

As shown in FIGS. 2 and 4 for example, the lower or ground engaging portion 22 of base 14 is octagonal in shape, but it will be appreciated that it may be of any other conventional configuration including D shaped, round or elliptical, among others. As shown in FIGS. 2 and 4, base 14 may have a hand hole 24 to facilitate on the job handling of the bases. By placing each pair of bases 14 in a back-to-back relationship, each portion 22 touching, a worker can easily carry four bases 14 using hand holes 24. That is, two bases 14 may be carried in each hand.

Figure 5:
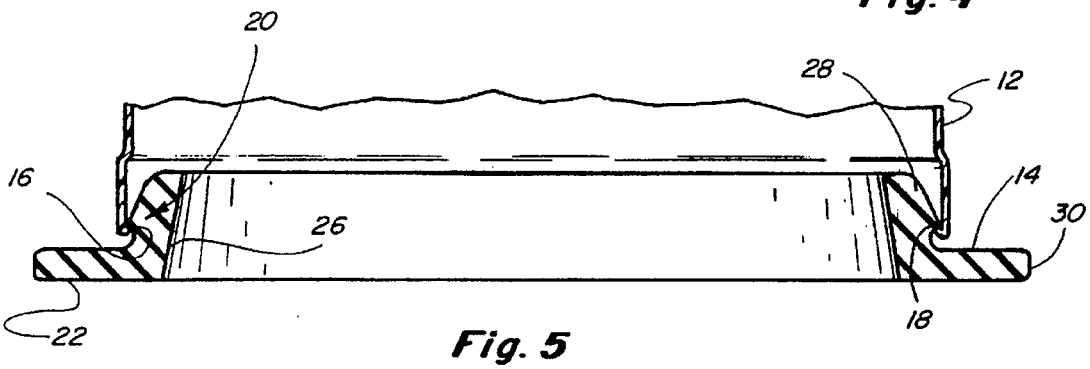
FIG. 5 is a partial cross-sectional view of the barrel and base of FIG. 1, taken along the plane of line 5—5 in FIG. 1.

As shown in FIG. 5, the interior of base 14 is bound by a wall 26 which extends around and forms the interior boundary of base 14, both of ground engaging portion 22 of base 14 and pedestal portion 20 of base 14. Wall 26 has an inclination from the vertical, or draft, as shown in FIG. 5. The draft of wall 26 assists in removing the base 14 from its mold. Pedestal portion 20 also has an exterior wall 28 which extends around and forms the exterior boundary of pedestal portion 20. Wall 28 also has an inclination from the vertical, or draft, as shown. The draft of wall 28 also assists in removing the base 14 from its mold. The inclination of walls 26 and 28 cooperate to give pedestal portion 20 a substantially triangular or tapered cross-section, as shown, with the taper narrowing toward the top of pedestal portion 20. If desired, the walls 26 and 28 may be sufficiently inclined to permit a pedestal portion 20 of a base 14 to nest with a ground engaging portion 22 of a separate base 14.

The taper of walls 26 and 28 also provides another important function in cooperation with the relieved center, or annular shape, of base 14. Pedestal portion 20 is very resilient and flexible. As a result, when a vehicle tire contacts pedestal portion 20, the pedestal portion 20 flexes into a flattened configuration thus presenting a barrier having a lower effective height, in essence, presenting a much lower and safer obstacle to the contacting vehicle. This feature does not sacrifice the durability of base 14 due to the resilience of the material of construction.

As shown in FIGS. 3 and 4, base 14 includes a hand-hole 24 for ease of carrying. It will be appreciated that hand-hole 24 may be included or not as desired and other means of manually carrying may be provided, including placing the outer wall 30 of base 14 sufficiently close to inner wall 26 allowing the edge of base 14 to be readily grasped by the fingers of a hand.

The composition of base 14, as noted herein, is preferably of highly compact and resilient material, such as recycled rubber from reprocessed automobile tires. This material may be molded and cured as is conventional in the art. Base 14 may also include sufficient new rubber or other elastomer polymers to bind the reprocessed rubber into a firm, resilient, unitary whole in a manner known in the art.

It will be readily understood by those skilled in the art that variations may be made to the embodiments disclosed herein without departing from the spirit of the invention disclosed. It is intended that the invention not be limited to the preferred embodiments, which are disclosed herein for purposes of illustration, but rather that the invention be limited only by the scope of the claims appended hereto and their equivalents.

I claim:

1. A low profile self-ballasting base for traffic control barrels comprising a dense, compact, resilient platform, the base having a barrel engaging portion and a bottom surface for contacting a roadway, the barrel engaging portion having a peripheral fastener for releasably engaging a complementary shaped traffic barrel, the barrel engaging portion being releasable on impact of a motor vehicle with the barrel, the base being annular in shape and having its mass concentrated at the outer periphery thereof to provide weight reduction and strength to the base, the base being sufficiently heavy that additional ballast is not required and the base is substantially self-ballasting when combined with a traffic channelizer barrel.

2. The base of claim 1 wherein the base is at least partially formed of recycled rubber from automobile tires.

3. The base of claim 1 wherein the barrel engaging portion is flexible and responsive to contact with a vehicle to provide a reduction in the effective height of the base.

4. The base of claim 3 wherein the barrel engaging portion is at least partially tapered.

5. The base of claim 4 wherein the barrel engaging portion is tapered upwardly.

6. The base of claim 1 wherein the base has a cross-section with a substantial portion of the mass concentrated in the bottom thereof.

7. The base of claim 1 wherein the base is stackable.

8. The base of claim 7 wherein the base is nestable.

9. The base of claim 1 where in the base includes a hand hole at its periphery.

10. A low profile self-ballasting base for traffic control barrels comprising a dense, compact, resilient platform, the base having a barrel engaging portion and a bottom surface for contacting a roadway, the barrel engaging portion having a peripheral fastener for releasably engaging a complementary shaped traffic barrel, the barrel engaging portion being releasable on impact of a motor vehicle with the barrel, the barrel engaging portion being flexible and responsive to contact with a vehicle to provide reduction in the effective height of the base and reduce the obstacle posed by the base to passage of a vehicle, the base being annular in shape and having its mass concentrated at the outer periphery thereof, the barrel engaging portion of the base terminating at the inner periphery of the annular shape, and the base having a cross-section wherein a substantial portion of its mass is concentrated at the bottom thereof to provide weight reduction and strength to the base, the base being sufficiently heavy that additional ballast is not required and the base is substantially self-ballasting when combined with a traffic channelizer barrel.

11. The base of claim 10 wherein the base weighs between about 18 to 20 pounds.

12. The base of claim 10 wherein the base has hand-hold means permitting an individual to conveniently carry multiple bases.

13. A low profile self-ballasting base for traffic control barrels comprising a dense, compact, resilient platform, the base having a barrel engaging portion and a bottom surface for contacting a roadway, the barrel engaging portion having a peripheral fastener for releasably engaging a complementary shaped traffic barrel, the barrel engaging portion being releasable on impact of a motor vehicle with the barrel, the barrel engaging portion being flexible and responsive to contact with a vehicle to provide reduction in the effective height of the base and reduce the obstacle posed by the base to passage of a vehicle, the base being annular in shape and having its mass concentrated at the outer periphery thereof, the barrel engaging portion of the base terminating at the inner periphery of the annular shape, and the annular shape of the base having a tapered cross-section wherein a substantial portion of the mass of the base is concentrated at the bottom thereof to provide weight reduction and strength to the base, the base being sufficiently heavy that additional ballast is not required and the base is substantially self-ballasting when combined with a traffic channelizer barrel, the tapered cross-section of the annular shape of the base having sufficient inclination to permit the base to nest into the bottom surface of a separate base.

14. The base of claim 10 wherein the base weighs between about 18 to 20 pounds.

15. The base of claim 10 wherein the base has handhold means permitting an individual to conveniently carry multiple bases.

* * * * *